US005536224A

United States Patent [19]

Hsieh

[11] Patent Number: 5,536,224

[45] Date of Patent: Jul. 16, 1996

[54] STRIDING EXERCISE APPARATUS

[75] Inventor: Yi F. Hsieh, Succasunna, N.J.

[73] Assignee: LifeGear, Inc., Rockaway Township, N.J.

[21] Appl. No.: 558,671

[22] Filed: Nov. 16, 1995

[51] Int. Cl.[6] ..... A63B 22/00

[52] U.S. Cl. ..... 482/51; 482/70; 434/255

[58] Field of Search ..... 482/51, 54, 70, 482/111, 112, 125; 434/247, 255; 601/35, 33

[56] References Cited

U.S. PATENT DOCUMENTS

| | | | |
|---|---|---|---|
| 4,850,585 | 7/1989 | Dalebout | 272/70 |
| 4,940,233 | 7/1990 | Bull et al. | 482/70 |
| 4,989,858 | 2/1991 | Young et al. | 482/53 |
| 5,000,443 | 3/1991 | Dalebout et al. | 482/51 |
| 5,104,363 | 4/1992 | Shi | 482/73 |
| 5,290,211 | 3/1994 | Stearns | 482/53 |
| 5,419,747 | 5/1995 | Piaget et al. | 482/51 |

*Primary Examiner*—Stephen R. Crow
*Attorney, Agent, or Firm*—David L. Davis

[57] ABSTRACT

Striding exercise apparatus comprising a frame having a base adapted to be supported on a horizontal surface and a pair of spaced upright supports each secured to and extending upwardly from the base. Each of the spaced upright supports has mounted thereto a respective stride assembly which includes a leg member and an arm member. The leg and arm members are pivotally mounted to their respective supports and a mechanism is provided for interconnecting the respective leg and arm members for concurrent pivoting movement in opposite angular directions.

27 Claims, 5 Drawing Sheets

STRIDING EXERCISE APPARATUS

BACKGROUND OF THE INVENTION

This invention relates to exercise apparatus and, more particularly, to apparatus for effecting a non-impact aerobic workout of the user. Specifically, the type of exercise facilitated by the inventive apparatus is striding.

Non-impact aerobic workouts are known to be beneficial for cardiovascular fitness while at the same time not being deleterious to the bones and joints of the individual. While it is possible to achieve such a workout without the assistance of any apparatus, it is often inconvenient and difficult to do so. Thus, if one wanted to use walking as an exercise, since walking involves only slight impact, the ability to do so outdoors is influenced by the weather. A particularly effective type of walking is known as "striding", wherein long steps are taken with exaggerated swinging of the arms, often while holding weights in both hands. In addition to weather related problems, when performing such an exercise outdoors, uneven terrain can make the exercise difficult and can even result in injuries. It is therefore an object of the present invention to provide exercise apparatus which facilitates a striding workout that can be performed indoors.

U.S. Pat. No. 4,850,585 to Dalebout discloses a striding exerciser having a frame and a pair of pivoting leg members which support a user above the floor. A pair of handle members pivot about the same axis as the leg members. In one embodiment, a reciprocation mechanism is provided to force opposite rotation of the pair of leg members with respect to each other. A disadvantage of the Dalebout apparatus is that the hand members cause the user's arms to "pole", rather than swing, since the pivot axes of the handle members are below the user's shoulders. This "poling" is not a natural movement. It is therefore another object of this invention to provide striding exercise apparatus by means of which the user partakes of natural body movements.

U.S. Pat. No. 5,419,747 to Piaget et al discloses striding exercise apparatus wherein the pivot axes for the arm members are above the pivot axes for the leg members. Hydraulic cylinders are connected to the arm and leg members to provide resistance when the arm and leg members are reciprocated. This adds expense to the apparatus and, further, does not insure that natural motion is simulated when using the apparatus. It is therefore a further object of this invention to provide striding exercise apparatus of the type described which is inexpensive, which utilizes the user's own body weight as resistance, and which forces the user to partake of natural body movements when striding.

SUMMARY OF THE INVENTION

The foregoing and additional objects are attained in accordance with the principles of this invention by providing exercise apparatus comprising a frame having a base adapted to be supported on a horizontal surface and a pair of spaced upright supports each secured to and extending upwardly from the base. A pair of stride assemblies are provided, each mounted to a respective one of the pair of spaced upright supports and between the pair of spaced upright supports. Each of the stride assemblies includes a leg member pivotally mounted to its respective support at a horizontal first pivot axis, a foot platform mounted to the leg member at a location remote from the first pivot axis and adapted to support a user thereon, an arm member pivotally mounted to its respective support at a horizontal second pivot axis parallel to, spaced from, and above, the first pivot axis, and a hand grip mounted to the arm member at a location remote from the second pivot axis. Each of the stride assemblies further includes means for interconnecting its leg member and arm member for concurrent movement in opposite angular directions about their respective pivot axes.

In accordance with an aspect of this invention, the means for interconnecting includes a plurality of meshed gear members. In particular, there are an even number of meshed gear members. Further, the means for interconnecting provides a ratio of angular movement of the arm member to the leg member of approximately four to three.

In accordance with another aspect of this invention, the apparatus further includes lock means for selectively preventing movement of each of the stride assemblies. Accordingly, a user can mount the apparatus while it is stationary.

In accordance with a further aspect of this invention, each of the stride assemblies further includes means cooperating with the arm member for selectively adjusting the distance between the hand grip and the second pivot axis. Accordingly, the apparatus can be used by people of different size.

In accordance with still another aspect of this invention, the frame further includes a stabilizer bar secured at each of its ends to a respective one of the spaced upright supports remote from the base.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
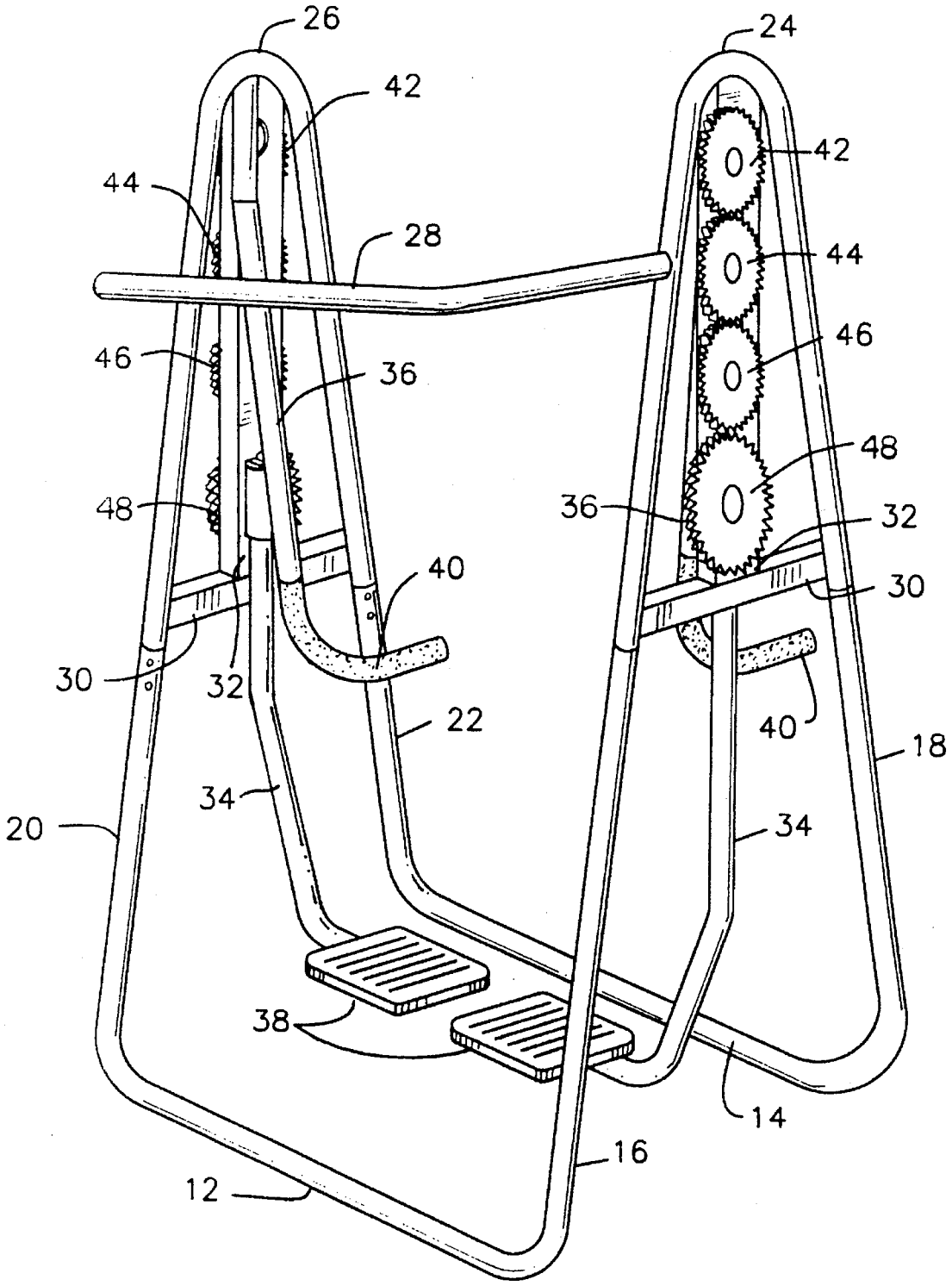
FIG. 1 is a perspective view of illustrative striding exercise apparatus constructed in accordance with the principles of this invention.
Figure 2:
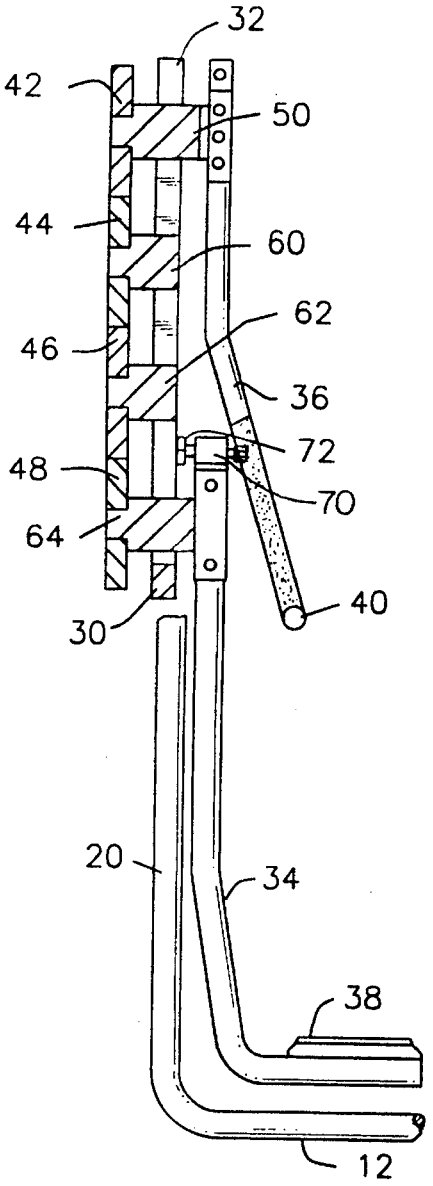
FIG. 2 is a partially cut away and sectioned elevational view of the exercise apparatus of FIG. 1 showing the mounting of the gears and their connections to the arm and leg members.
Figure 3:
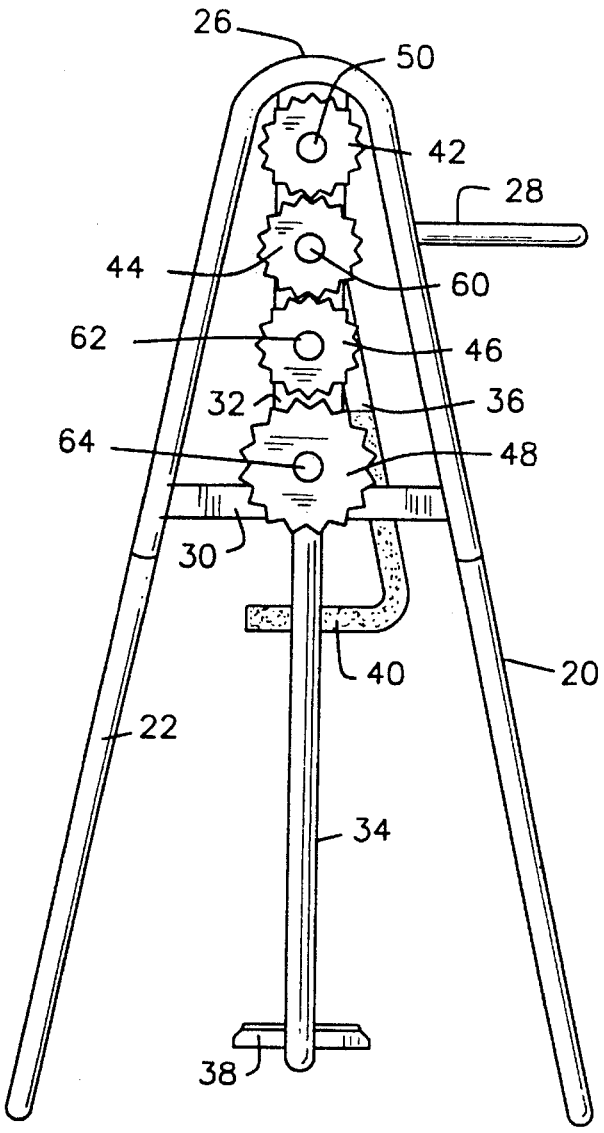
FIG. 3 is a side view of the exercise apparatus of FIG. 1 showing the gears.
Figure 4:
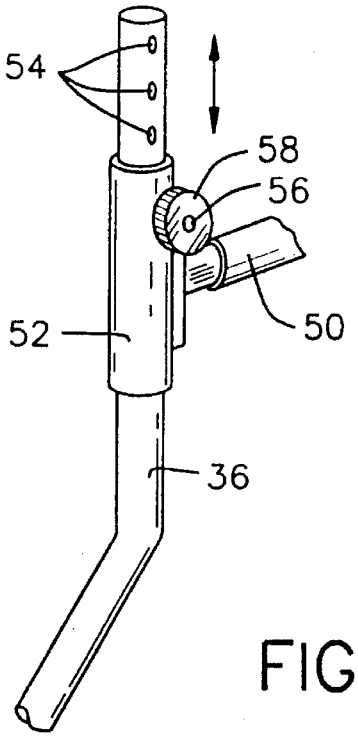
FIG. 4 is an enlarged view showing a mechanism for adjusting the effective length of an arm member.
Figure 5:
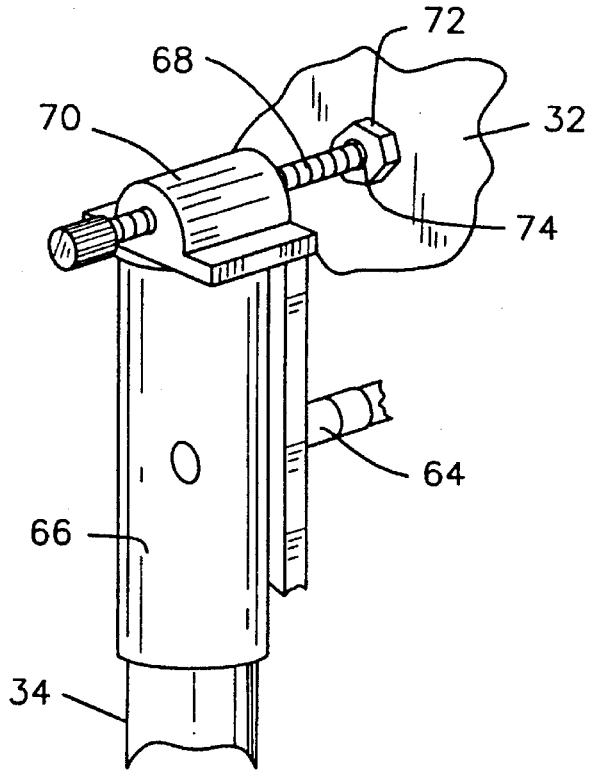
FIG. 5 is an enlarged view showing an illustrative mechanism for locking the movement of a stride assembly.

Referring to FIGS. 1–3 of the drawings, a first embodiment of exercise apparatus according to the present invention includes a frame formed out of sections of rigid tubing, illustratively steel, which are bent and connected together so as to provide a base and a pair of spaced upright supports. The base includes a pair of horizontal sections 12, 14 which are adapted to be supported on a horizontal surface. Each of the spaced upright supports has a pair of substantially straight sections 16, 18 and 20, 22. The straight sections 16, 18, 20, 22 are each secured at one end to a respective end of a respective one of the horizontal base sections 12, 14 and at its other end to the other straight section of its support so that each support is shaped substantially as an inverted V having a vertex 24, 26. As shown, it is preferable that the rigid tubing is formed as a continuous curve at each vertex 24, 26 and at each joining of a straight support section 16, 18, 20, 22 to a horizontal base section 12, 14, rather than having sharp bends. Effectively, the frame is formed as a "continuous" loop of rigid tubing. To provide stability to the aforedescribed frame, there is further provided a stabilizer bar 28, which is also formed of rigid tubing, has a substantially C-shape, and is secured at a first end to the straight support section 16 and at a second end to the straight support section 20. Forming the frame out of sections allows the apparatus to be disassembled for shipping.

Each of the upright supports also includes a horizontal cross bar 30 secured at a first end to the respective straight section 16 or 20 and at a second end to the respective straight section 18 or 22, below the respective vertex 24 or 26. Further, each upright support has a vertical support bar 32 secured at its lower end to the respective cross bar 30 and at its upper end to the rigid tubing of its support in the vicinity of the respective vertex 24 or 26.

The illustrated exercise apparatus also includes a pair of stride assemblies each mounted to a respective one of the pair of spaced upright supports. The stride assemblies are adapted to support a user performing striding exercises between the pair of spaced upright supports. Each of the stride assemblies includes a leg member 34 and an arm member 36. The leg member 34 is formed from a length of rigid tubing material, illustratively steel, and is oriented generally vertically. At its lower end, the leg member 34 is bent into a general L-shape, toward the other leg member 34, where it has secured thereto a foot platform 38. The foot platforms 38 are adapted to support a user in an upright position between the pair of spaced upright supports. The upper end of the leg member 34 is pivotally mounted to its respective vertical support bar 32 at a horizontal first pivot axis, as will be described in full detail hereinafter. The arm member 36 is likewise formed from a section of rigid tubing material, illustratively steel, and is bent at one end into a generally L-shaped configuration to provide a hand grip 40, which may be covered with a cushioning foam material. The other end of the arm member 36 is pivotally mounted to its respective vertical support bar 32 at a horizontal second pivot axis, as will be described in full detail hereinafter. The second pivot axis is parallel to, spaced from, and above, the first pivot axis.

As shown, each of the stride assemblies further includes four gears 42, 44, 46, and 48, which together form a gear train, mounted to the vertical support bar 32 on the exterior thereof. This gear train functions to interconnect the leg member 34 with the arm member 36 for concurrent pivoting movement in opposite angular directions about their respective pivot axes. Although four gears are illustrated herein, it is apparent that any even number of "serially" connected gears will cause the leg member 34 and the arm member 36 to partake of concurrent pivoting movement in opposite angular directions.

As shown in FIG. 2, the gear 42 is secured to the shaft 50 for rotation therewith, the shaft 50 being journalled for rotation through the vertical support bar 52. The position of the shaft 50 is such that it is at approximately shoulder level of an average size user of the exercise apparatus, when the user is standing on the foot platforms 38. The other end of the shaft 50 has secured thereto a straight section 52 of elongated tubing having a longitudinal axis orthogonal to the axis of the shaft 50. The inside diameter of the section 52 is slightly larger than the outside diameter of the tubing making up the arm member 36 so that the arm member 36 is slidable within the tubing section 52 in the direction defined by the longitudinal axis, that is, orthogonally of the axis of the shaft 50. The arm member 36 is formed with an array of apertures 54 along a line parallel to the longitudinal axis of the tubing section 52. Extending through an aperture (not shown) in the tubing section 52 is a rod 56 secured to a knob 58. The rod 56 is sized to fit within the apertures 54. Illustratively, the rod 56 has external threads and the aperture of the tubing section 52 through which it extends has internal threads so that by turning the knob 58, the rod 56 can be moved selectively either inwardly or outwardly of the tubing section 52 so as to enter a selected one of the apertures 54. In this way, the arm member 36 can be moved generally vertically so that the distance between the hand grip 40 and the axis of the shaft 50 can be selectively adjusted to accommodate users of differing size.

The gear 44 is mounted to the shaft 60, which is journalled for free rotation through the vertical support bar 32. The gear 46 is mounted to the shaft 62, which is also journalled for free rotation through the vertical support bar 32. The gear 48 is secured to the shaft 64 for rotation therewith. The shaft 64 is journalled for rotation through the vertical support bar 32. The position of the shaft 64 is such that it is at approximately hip level of an average size user of the exercise apparatus, when the user is standing on the foot platforms 38. The axes of all of the shafts 50, 60, 62, 64 are parallel to each other and are all substantially horizontal.

The end of the shaft 64 remote from the gear 48 has secured thereto a straight section 66 of rigid tubing of sufficient diameter that the leg member 34 fits relatively snugly therein. The leg member 34 is secured to the tubing section 66 so that it pivots with the shaft 64. As best seen in FIG. 3, the gears 42, 44, 46, 48 have their teeth engaged so as to form a serial gear train which interconnects the leg member 34 and the arm member 36 for concurrent pivoting movement in opposite angular directions. It is known that when a person strides, the arms partake of a greater angular rotation than the legs. Specifically, the ratio of angular movement of a person's arms to legs is approximately four to three. Accordingly, the gears 42, 44, 46, 48 are chosen to provide such a ratio of angular movement between the arm member 36 and the leg member 34. Illustratively, the gears 42, 44, 46 are all of the same size with fifty four teeth and the gear 48 has seventy four teeth.

To provide stability so that the user can easily mount and dismount the stride assemblies, there is provided a locking mechanism associated with each of the stride assemblies for selectively preventing movement of that stride assembly. The lock mechanism includes a rod 68 mounted to the leg member 34 for axial movement toward and away from the vertical support bar 32. Illustratively, the mounting is provided by a barrel 70 supported on the end of the leg member 34 and adapted to contain the rod 68 therein. For cooperating with the rod 68, a body 72 is fixedly mounted to the vertical support bar 32. The body 72 has a cavity 74 sized to accept the end of the rod 72 therein. Illustratively, the body 72 may be an oversized bolt which is welded to the vertical support bar 32. The body 72 is so positioned on the vertical support bar 32 that the rod 68 is aligned with the cavity 74 when the leg member 34 is in a predetermined angular orientation. Preferably, this orientation is such that the foot platform 38 is in its lowermost position. Thus, before the user steps onto the foot platforms 38, the leg members 34 are positioned with the foot platforms 38 in their lowermost positions and the rod 68 is moved toward the vertical support bar 32 until its end enters the cavity 74. This prevents the leg members 34 from partaking of pivoting movement. Since the arm members 36 are interconnected to the respective leg members 34, they are likewise prevented from partaking of angular movement. Thus, the stride assemblies can be locked so that they do not move when the user steps on or off the foot platforms 38.

Figure 6:
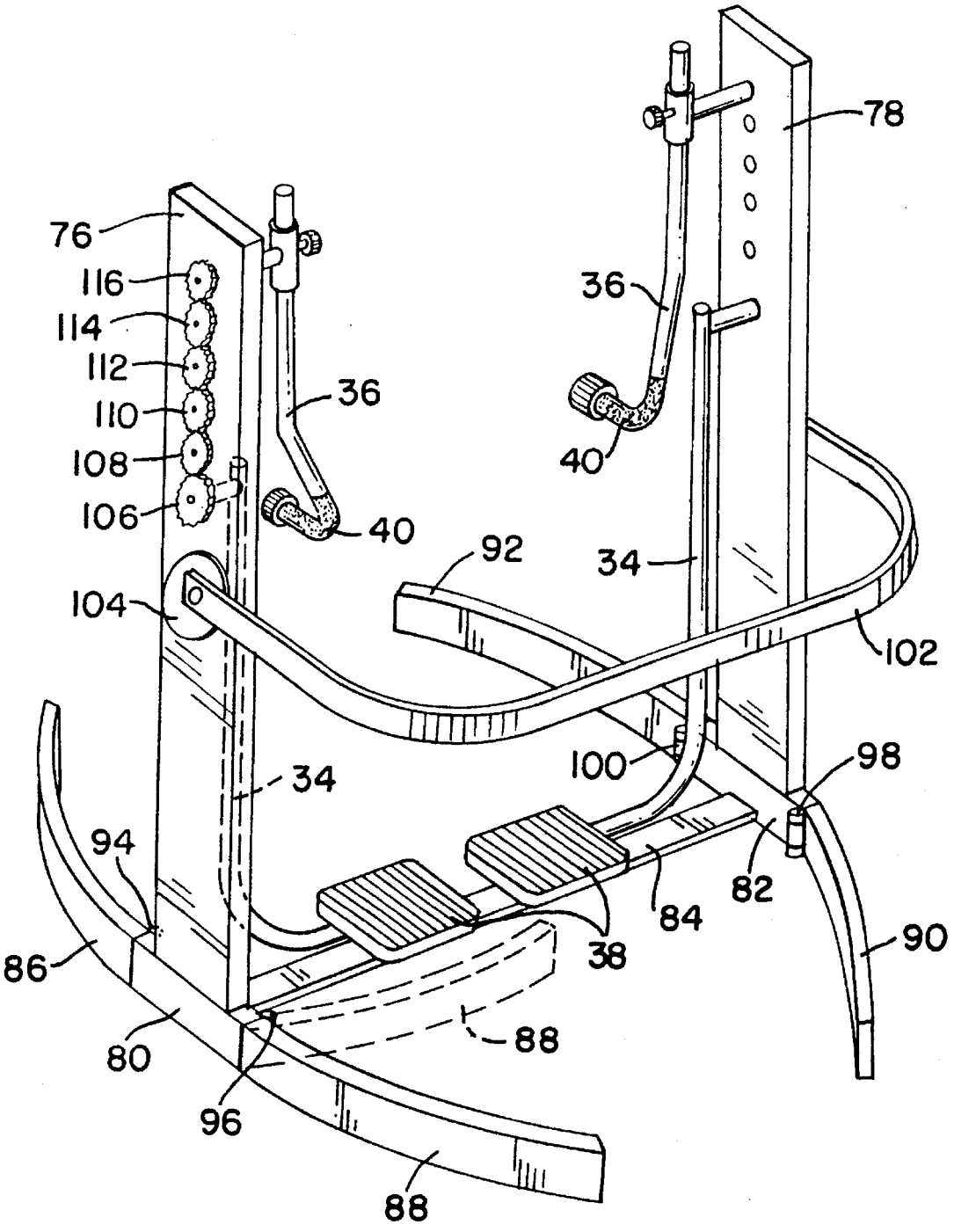
FIG. 6 is a perspective view of another embodiment of striding exercise apparatus constructed according to this invention.

FIG. 6 shows another embodiment of striding exercise apparatus constructed according to this invention. The stride assemblies of the embodiment shown in FIG. 6 are substantially the same as the stride assemblies of the embodiment shown in FIGS. 1–4, but the embodiment shown in FIG. 6 includes a frame which advantageously may be partially collapsed for easy storage thereof. Thus, the embodiment shown in FIG. 6 includes a pair of upright support members 76, 78 which may be described generally as flat beams extending generally vertically from respective base members 80, 82. The base members 80,82 are connected by a transverse bar 84. The remainder of the base portion of the apparatus shown in FIG. 6 includes four base arms 86, 88, 90, 92 which are connected to the base members 80, 82, as shown. Thus, the arms 88, 90 extend forwardly from the base members 80, 82, respectively, and the arms 86, 92 extend rearwardly from the base members 80,82, respectively, so that the arms 86, 88, 90, 92 together with the transverse bar 84 and the base members 80, 82 form a generally H-shaped base. The connections of the arms 86, 88, 90, 92 to the base members 80, 82 is by means of respective hinges 94, 96, 98, 100 so that the arms 86, 88, 90, 92 may be folded inwardly toward the transverse bar 84 (as shown in broken lines for the arm 88) to partially collapse the base so that it has a smaller footprint and is more easily stored. As with the embodiment of FIGS. 1–4, the embodiment of FIG. 6 includes a stabilizer bar 102 which is substantially C-shaped and is secured at its ends to the support members 76, 78. The attachment of the stabilizer bar 102 to the support members 76, 78 is such that it can be folded downwardly toward the base for storage. Such attachment may be by hinges or by a pivotal connection, as illustrated generally at 104.

For interconnecting the leg and arm members 34, 36 of each of the stride assemblies, there is provided on each of the upright support members 76, 78 a gear train which illustratively includes six gears 106, 108, 110, 112, 114, 116. Illustratively, the gear 106 has thirty one teeth and the gears 108, 110, 112, 114, 116 each has twenty three teeth, thereby providing the desired ratio of angular movement between the arm member 36 and the leg member 34 of approximately four to three.

Figure 7:
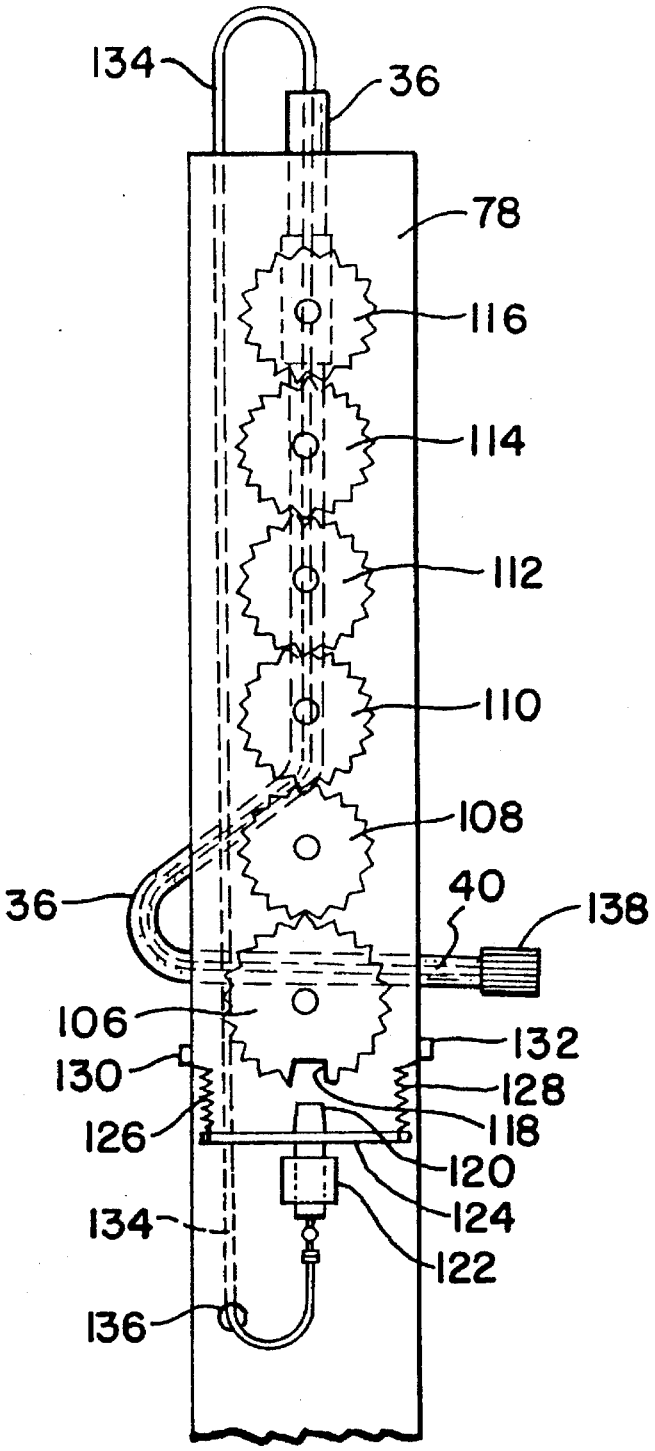
FIG. 7 shows another embodiment of a mechanism for locking the movement of a stride assembly.

FIG. 7 shows another embodiment of a mechanism for locking the movement of a stride assembly. As shown, the gear 106, which is directly coupled to the leg member 34, is formed with a tapered cavity 118 which is so positioned on the gear 106 that when the foot platform 38 is in its lowest position, the cavity 118 is also in its lowest position. The cavity 118 cooperates with a lock pin 120 which is mounted to the support member 78 by means of the guide sleeve 122 so that it partakes of axial movement toward and away from the gear 106. Specifically, the lock pin 122 is arranged to move vertically so that when the cavity 118 is in its lowest position, it is in the axial line of travel of the lock pin 120. Preferably, the lock pin 120 is tapered at its forward end so that it easily enters the tapered cavity 118.

Secured to the lock pin 120 and extending transversely thereto is a flange 124. A pair of springs 126, 128 are connected, each at one end, to opposite ends of the flange 124. At their other ends, the springs 126, 128 are secured to standoffs 130, 132, respectively, secured to the support member 78. Accordingly, the springs 126, 128 bias the lock pin 120 toward the gear 106.

The lock pin 120 is connected at its lower end to a cable 134 which preferably is snaked through the support member 76 (through the opening 136) and through the arm member 36. The cable 134 is terminated by the knob 138 secured at the end of the hand grip 40. Turning the knob 138 in a first direction tightens the cable 134 and pulls the lock pin 120 against the biasing force of the springs 126, 128 out of the cavity 118. Turning the knob 138 in the opposite direction loosens the cable 134 and allows the springs 126, 128 to pull the lock pin 120 toward the gear 106, so that it enters the cavity 118 (assuming that the cavity 118 is in its lowest position) to prevent movement of the stride assembly.

By interconnecting the arm members 36 and the leg members 34 for concurrent pivoting movement in opposite angular directions, the described striding exercise apparatus eliminates the need for separate resistance providing means and instead utilizes the user's own body weight as resistance. Further, this interconnection of the arm members and the leg members forces the user to partake of natural body movements when striding.

Although not shown, the illustrated striding apparatus may also have covers secured to the upright supports, which hide the gears from view. The covers provide a pleasing aesthetic appearance, provide a place for the manufacturer to place written material such as a logo and model identification, prevent dirt from jamming the mechanism, and protect the user or an onlooker from catching a body part or clothing between the gears.

Accordingly, there has been disclosed improved striding exercise apparatus for effecting a non-impact aerobic workout of the user. It is understood that the above-described embodiments are merely illustrative of the application of the principles of this invention. Numerous other embodiments may be devised by those skilled in the art without departing from the spirit and scope of this invention, as defined by the appended claims.

What is claimed is:

1. Exercise apparatus comprising:

a frame having a base adapted to be supported on a horizontal surface and a pair of spaced upright supports each secured to and extending upwardly from said base; and a pair of stride assemblies each mounted to a respective one of said pair of spaced upright supports and between said pair of spaced upright supports, each of said stride assemblies including:

a leg member pivotally mounted to its respective support at a horizontal first pivot axis;

a foot platform mounted to said leg member at a location remote from said first pivot axis and adapted to support a user thereon;

an arm member pivotally mounted to its respective support at a horizontal second pivot axis parallel to, spaced from, and above, said first pivot axis;

a hand grip mounted to said arm member at a location remote from said second pivot axis; and direct drive means for interconnecting said leg member and said arm member for concurrent movement in opposite angular directions about their respective pivot axes.

2. The apparatus according to claim 1 wherein said means for interconnecting includes a plurality of meshed gear members.

3. The apparatus according to claim 1 wherein said means for interconnecting includes an even number of meshed gear members.

4. The apparatus according to claim 1 wherein said means for interconnecting provides a ratio of angular movement of said arm member to said leg member of greater than one to one.

5. The apparatus according to claim 4 wherein said ratio is approximately four to three.

6. The apparatus according to claim 1 further including lock means for selectively preventing movement of each of said stride assemblies.

7. The apparatus according to claim 1 wherein each of said stride assemblies further includes means cooperating with said arm member for selectively adjusting the distance between said hand grip and said second pivot axis.

8. The apparatus according to claim 1 wherein said frame further includes a stabilizer bar secured at each of its ends to a respective one of said spaced upright supports remote from said base.

9. Exercise apparatus comprising:

a base adapted to be supported on a horizontal surface;

a pair of spaced upright supports each secured to and extending upwardly from said base, each of said spaced upright supports including a vertical support bar; and a pair of stride assemblies each mounted to a respective one of said pair of spaced upright supports and between said pair of spaced upright supports, each of said stride assemblies including:

a horizontal first shaft mounted to said vertical support bar for rotation about the axis of said first shaft;

a horizontal second shaft mounted to said vertical support bar above said first shaft axis and parallel to said first shaft axis for rotation about the axis of said second shaft;

a first gear mounted to said first shaft for rotation therewith;

a second gear mounted to said second shaft for rotation therewith, said second gear being coupled to said first gear so that said first and second shafts are interconnected for concurrent rotation in opposite angular directions;

a leg member secured to said first shaft for rotation therewith;

a foot platform mounted to said leg member at a location remote from said first shaft and adapted to support a user thereon;

an arm member secured to said second shaft for rotation therewith; and a hand grip mounted to said arm member at a location remote from said second shaft.

10. The apparatus according to claim 9 wherein said first gear has at least as many teeth as said second gear.

11. The apparatus according to claim 10 wherein the ratio of the number of teeth on said first gear to the number of teeth on said second gear is approximately four to three.

12. The apparatus according to claim 11 wherein said first gear has seventy four teeth and said second gear has fifty four teeth.

13. The apparatus according to claim 11 wherein said first gear has thirty one teeth and said second gear has twenty three teeth.

14. The apparatus according to claim 9 further including:

an even number of additional horizontal shafts parallel to said first and second shaft axes and each rotatively mounted to said vertical support bar at spaced locations between said first and second shaft axes; and an even number of additional gears each mounted to a respective one of said additional shafts for rotation about a respective gear axis, said additional gears together forming a gear train connecting said first gear to said second gear.

15. The apparatus according to claim 14 wherein the ratio of the number of teeth on said first gear to the number of teeth on said second gear is approximately four to three and wherein said additional gears have the same number of teeth as each other.

16. The apparatus according to claim 15 wherein said first gear has seventy four teeth, said second gear has fifty four teeth, and there are two additional gears each having fifty four teeth.

17. The apparatus according to claim 15 wherein said first gear has thirty one teeth, said second gear has twenty three teeth, and there are four additional gears each having twenty three teeth.

18. The apparatus according to claim 9 further including lock means associated with each of said stride assemblies for selectively preventing movement of said each stride assembly.

19. The apparatus according to claim 18 wherein said lock means includes:

a rod mounted to said leg member for axial movement toward and away from said vertical support bar; and a body fixedly mounted to said vertical support bar and having a cavity sized to accept an end of said rod therein, said body being so positioned on said vertical support bar that said rod is aligned with said cavity when said leg member is in a predetermined angular orientation.

20. The apparatus according to claim 18 wherein said lock means includes:

a cavity formed in said first gear;

a lock pin mounted to said vertical support bar for axial movement therealong; and means for selectively moving said lock pin into and out of said cavity;

wherein said cavity is so positioned on said first gear that when said foot platform is in its lowest position said cavity is in the axial line of travel of said lock pin.

21. The apparatus according to claim 9 further comprising a stabilizer bar secured at each of its ends to a respective one of said spaced upright supports remote from said base.

22. The apparatus according to claim 21 wherein said stabilizer bar includes means proximate each of its ends for enabling said stabilizer bar to be pivoted downwardly toward said base.

23. The apparatus according to claim 9 wherein each of said stride assemblies further includes adjusting means cooperating with said arm member for selectively adjusting the distance between said hand grip and said second shaft.

24. The apparatus according to claim 23 wherein said adjusting means includes:

an elongated member having a longitudinal axis and secured to said second shaft for rotation therewith with said longitudinal axis being orthogonal to said second shaft axis, said arm member being slidable along said elongated member in the direction defined by said longitudinal axis; and securing means for releasably securing together said arm member and said elongated member.

25. The apparatus according to claim 24 wherein:

said arm member is formed with an array of apertures along a line parallel to said longitudinal axis; and said securing means includes a rod mounted to said elongated member for movement toward and away from said arm member, said rod being sized to fit within said apertures and positioned to intersect said line.

26. The apparatus according to claim 9 wherein said base includes:

a transverse member secured to and extending between said pair of spaced upright supports;

four arms, two of which extend forwardly and two of which extend rearwardly from a respective end of said transverse member so that said four arms and said transverse member together form a generally H-shaped base; and hinge means located between each of said arms and the respective end of said transverse member for enabling said arms to be folded inwardly toward said transverse member.

27. Exercise apparatus comprising:

a frame including first and second spaced upright support members;

first and second leg members respectively pivotably mounted on said first and second support members at a first pivot axis, said first and second leg members being operative for reciprocating movement between said support members, said first and second leg members each including a platform for supporting a user in an upright position between said leg members;

first and second arm members respectively pivotably mounted on said first and second support members at a second pivot axis which is positioned above said first pivot axis, said arm members being positioned above said leg members, said arm members being operative for reciprocating movement between said support members, said first and second arm members each including a hand grip; and direct drive means for interconnecting each pair of leg and arm members associated with each respective one of said support members for concurrent movement in opposite angular directions about the first and second pivot axes, respectively.

* * * * *